United States Patent [19]

Keeler, II

[11] 4,217,315

[45] Aug. 12, 1980

[54] HUMIDIFIER AND MOVING INDOOR SCULPTURE

[76] Inventor: Miner S. Keeler, II, 2525 Indian Trails, SE., Grand Rapids, Mich. 49506

[21] Appl. No.: 56,860

[22] Filed: Jul. 12, 1979

[51] Int. Cl.[2] ..... B01F 3/04

[52] U.S. Cl. ..... 261/120; D23/13; D23/146; 239/16; 239/17; 239/23; 261/25; 261/89; 261/DIG. 14

[58] Field of Search ..... 261/25, 36 R, 88, 89, 261/112, 120, DIG. 14, DIG. 79; D23/13, 146; 239/16, 17, 20, 22, 23

[56] References Cited

U.S. PATENT DOCUMENTS

| | | | |
|---|---|---|---|
| D. 205,392 | 7/1966 | Mifsud | D23/13 |
| 532,438 | 1/1895 | Bergquist | 261/89 |
| 655,121 | 7/1900 | Schaffstadt | 261/25 X |
| 772,347 | 10/1904 | Evans | 261/25 |
| 3,493,216 | 2/1970 | Johnson | 261/112 X |
| 3,901,439 | 8/1975 | Willis | 239/20 X |
| 3,917,759 | 11/1975 | Martin | 261/36 R |
| 4,092,379 | 5/1978 | Saxton | 261/25 |

FOREIGN PATENT DOCUMENTS

| | | | |
|---|---|---|---|
| 2534524 | 2/1977 | Fed. Rep. of Germany | 261/36 R |

*Primary Examiner*—Richard L. Chiesa

*Attorney, Agent, or Firm*—Price, Heneveld, Huizenga & Cooper

[57] ABSTRACT

A combination humidifier and moving indoor sculpture is provided comprising a reservoir containing a body of water, an upright helix rotatable about its longitudinal axis, and means for pumping water to the top of the helix. The helix floats on the surface of the body of water, and the water pumped to the top of the helix flows down the helix under the influence of gravity adding humidity to the surrounding atmosphere and rotatably driving the helix due to the change of momentum of the water flowing down the helix.

10 Claims, 2 Drawing Figures

HUMIDIFIER AND MOVING INDOOR SCULPTURE

BACKGROUND OF THE INVENTION

This invention relates generally to humidifiers and, more particularly, to a large combination humidifier and moving indoor sculpture of the type that may be used in a shopping mall or the like.

Large, enclosed shopping malls have become prevalent in many areas of the country. These shopping malls provide access to a plurality of merchandising outlets disposed along the mall while providing customers with shelter from inclement weather and extreme hot or cold weather. Furthermore, the mall provides a central meeting area where activities sponsored by the shopping center may be carried out. In many ways, these enclosed shopping malls have become centers of commerce and social activity of suburban society.

Typically, the enclosed mall is appointed with shrubs and decorations which often include a large fountain and/or indoor sculpture. In climates where the relative humidity is extremely low, these indoor fountains and/or sculptures also serve the purpose of adding needed humidity to the atmosphere of the malls. Because of the increasing cost of energy, fountain displays requiring relatively large pressure heads for generating a decorative display of water projecting into the air have become prohibitively expensive to operate.

SUMMARY OF THE INVENTION

According to the present invention, a combination humidifier and moving sculpture is provided comprising a reservoir containing a body of water, an upright helix, the helix being rotatable about its longitudinal axis, and means for floating the helix on the surface of the body of water. Means for pumping water to the top of the helix is provided whereupon water flows down the helix under the influence of gravity and cascades from the edge of the helix. The water traveling down the helix and cascading over its edges adds humidity to the surrounding atmosphere and serves to rotatably drive the helix about its longitudinal axis due to a change of momentum of the water flowing down the helix. The large rotating helix, if not aesthetically pleasing, presents an object of curiosity and the large surface area of the water flowing on the helix serves to substantially increase the relative humidity of the atmosphere surrounding the helix. The humidifier of the present invention uses less energy than prior art fountains since it is not necessary to project water into the air as in the conventional fountain.

DESCRIPTION OF THE PREFERRED EMBODIMENTS

Figure 1:
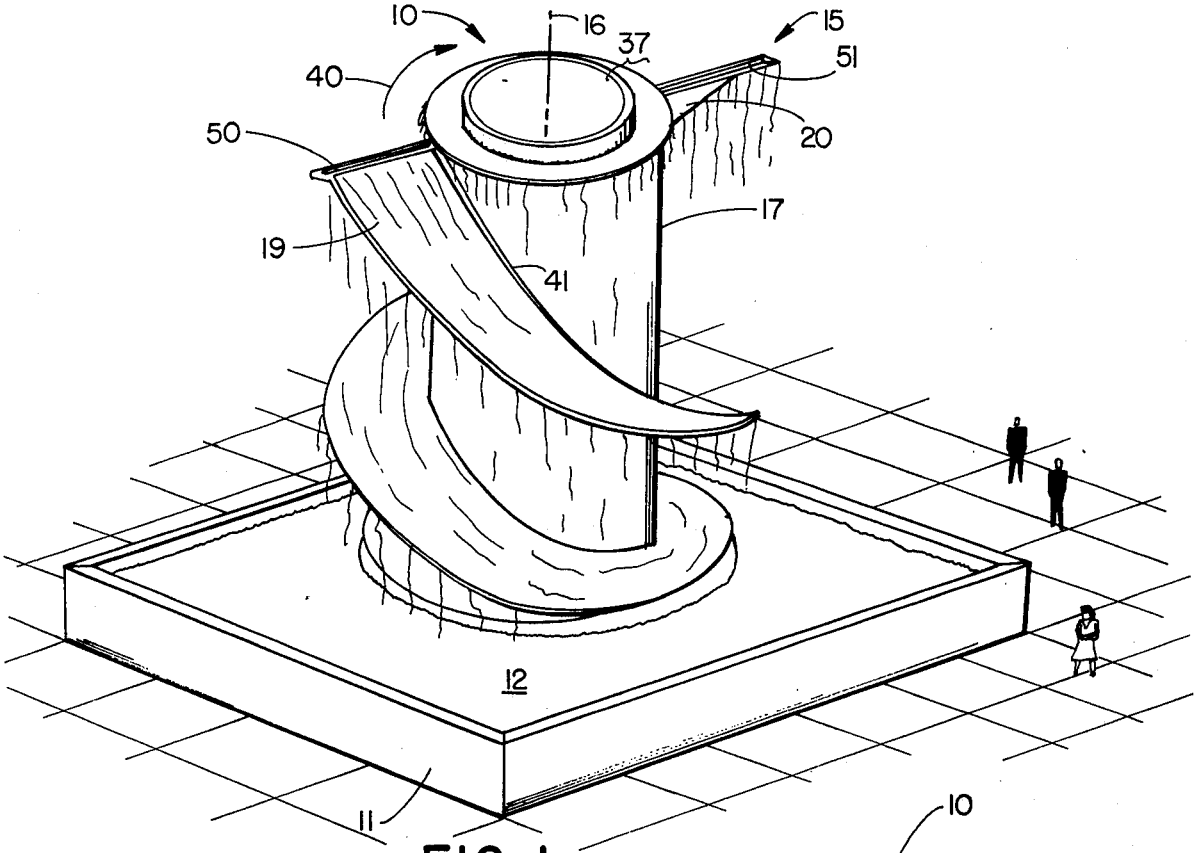
FIG. 1 is a perspective view of the combination humidifier and moving indoor sculpture of the present invention.
Figure 2:
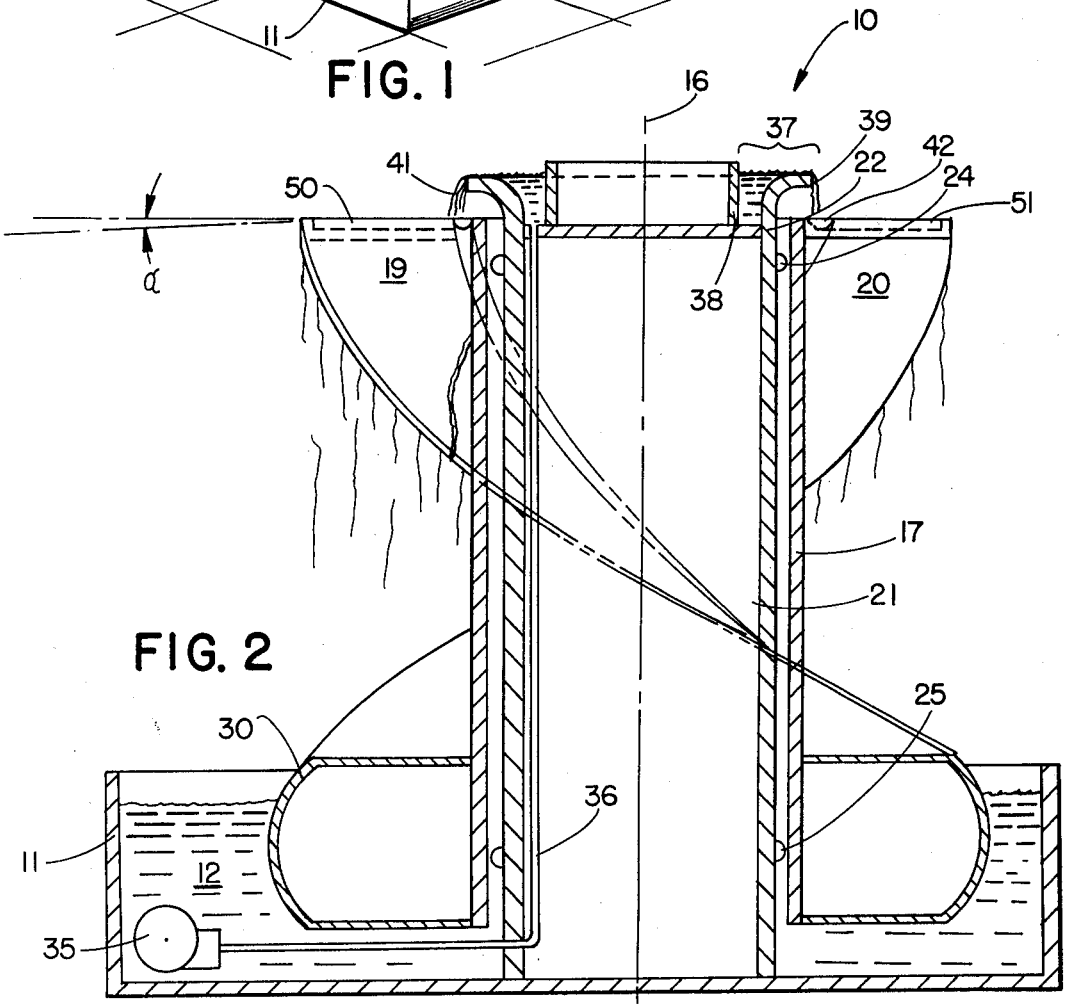
FIG. 2 is an elevational view partially in section of the combination humidifier and indoor sculpture of the present invention.

Referring now to FIGS. 1 and 2, the humidifier and sculpture of the present invention is illustrated at 10. The humidifier and sculpture 10 comprises a reservoir 11 for containing a body of water 12. An upright helix 15 is disposed in the body of water 12 and is rotatable about its longitudinal axis 16. Preferably, the helix comprises a body portion 17 having the shape of a right circular cylinder. The helix further includes at least one ramp such as the ramps 19 and 20 disposed along helical paths on the exterior of the body portion 17 of the helix 15. The body portion 17 of the helix 15 includes a central bore 21 through which an upright columnar support 22 extends. The upright columnar support 22 is centered about longitudinal axis 16 on the helix 15, and the helix 15 is journaled therearound. Teflon pads, rollers or the like at 24 and 25 may be provided for accurately centering the helix 15 about the upright columnar support 22 with a minimum of frictional loss.

The combination humidifier and sculpture 10 includes means for floating the helix of the surface on the body of water comprising a toroidal float 30. The toroidal float 30 is disposed at the bottom of the helix 15 surrounding the cylindrical body portion 17 of the helix. Support of the helix 15 by the toroidal float 30 also serves to keep frictional loss to a minimum.

Means for pumping water to the top of the helix is provided comprising a pump 35 having its suction side connected to the body of water 12 and its discharge side connected to an internal passageway, or line, 36 in upright columnar support 22. The passageway 36 supplies water to the top of the helix 15 via a structure at 37 for distributing water evenly about the periphery of the columnar structure 22. In this case, the distribution means comprises a circular trough 38 including an outturned lip 39 formed on the top of the columnar structure 22. However, it should be understood that a ring-shaped sparger or the like may be disposed atop columnar structure 22 for distributing water evenly in a circular array about the top of the helix 15.

The water distributed along the top of the helix 15 flows down the ramps of the helix 15 and where a plurality of ramps are provided, or where ramps overlap, the water cascades from ramp to ramp under the influence of gravity. This adds humidity to the surrounding atmosphere and rotatably drives the helix in the direction, of the arrow 40 due to the change of momentum of water flowing down the helix. Radially extending channels 50 and 51 are provided for distributing water evenly along the tops of the ramps of the helix 15.

The ramps 20 and 21 extend at an angle generally orthogonal to the cylindrical body portion 17 of the helix 15. Complete wetting of the ramps 19 and 20 is desirable since in general, as the surface area of a humidifier is increased, the greater its effectiveness in transferring moisture to the surrounding atmosphere. Thus, to ensure even wetting of the ramps 19 and 20 along their entire length and to ensure sufficient flow along the helix 15 to cause a change of momentum great enough to rotate the helix about its longitudinal axis, helical channels 41 and 42 are provided on ramps 19 and 20, respectively. The helical channels 41 and 42 are disposed along the interior of the ramps 19 and 20 to ensure that the ramps 19 and 20 are supplied with water along their entire length. Furthermore, the ramps 19 and 20 are preferably provided with a slight downslope in the radial direction, as indicated by the angle $\alpha$ in FIG. 2, the downslope being on the order of 1° to 5°. This slight downslope directs water, overflowing from the channels 41 and 42, over the ramps 19 and 20 in a continuous sheet whereupon it eventually cascades from the edges of the ramps 19 and 20.

It should be understood that embodiments of the invention are contemplated wherein a variety of different ramp structures are employed such as, for example, double or single helixes. Furthermore, it should be understood that the more gradual the pitch of the helix, the greater the change of momentum of water flowing down the helix. Of course, the change of momentum of the water flowing down the helix can also be increased by increasing the amount of water flowing down the helix. The torque generated by the change of momentum of water flowing along the helix may be increased by increasing the flow of water along the edges of the helix. Thus, an embodiment of the invention is contemplated wherein additional channels such as the channels 41 and 42 are provided, the additional channels being disposed about the periphery of the helical ramps 19 and 20. This increases the moment arm of the water flowing in the helical path along these channels and thus increases torque available for rotating the helix 15.

The above description should be considered as exemplary and that of the preferred embodiment only. The true spirit and scope of the present invention should be determined by reference to the appended claims. It is desired to include within the appended claims all modifications of the invention that come within the proper scope of the invention.

The embodiments of the invention in which an exclusive property or privilege is claimed are defined as follows:

1. A combination humidifier and moving indoor sculpture comprising:

a reservoir for containing a body of water;

an upright helix, said helix being rotatable about its longitudinal axis;

means for floating said helix on the surface of said body of water; and means for pumping water to the top of said helix whereupon water flows down said helix under the influence of gravity adding humidity to the surrounding atmosphere and rotatably driving said helix due to change of momentum of water flowing down said helix.

2. The combination humidifier and moving indoor sculpture of claim 1 further including a centrally located columnar structure defining the axis of rotation of said helix.

3. The combination humidifier and moving indoor sculpture of claim 2 wherein said helix comprises a body portion and at least one ramp disposed along a helical path on the exterior of said body portion.

4. The combination humidifier and moving indoor sculpture of claim 3 wherein said body portion comprises a right circular cylinder.

5. The combination humidifier and moving indoor sculpture of claim 4 wherein said body portion includes a central bore, said columnar structure extending therethrough.

6. The combination humidifier and moving indoor sculpture of claim 5 wherein said means for pumping water to the top of said helix comprises a pump having its suction side drawing from said body of water and its discharge side connected to a passageway within said columnar structure, said passageway supplying water to means for distributing water about the periphery of said columnar structure.

7. The combination humidifier and moving indoor sculpture of claim 4 wherein said means for floating said helix comprises a toroidal float disposed about the bottom of said body portion of said helix.

8. The combination humidifier and moving indoor sculpture of claim 3 wherein said ramp includes means for evenly distributing a sheet of water along said ramp comprising a helical channel disposed along the interior of said helical ramp, said channel being supplied with water by means for pumping and said channel distributing water along the length of said ramp.

9. The combination humidifier and moving indoor sculpture of claim 8 wherein said ramp extends approximately orthogonally to said body, said ramp being provided with a slight radial downslope to ensure that said ramp is covered with a sheet of water extending from said channel and eventually cascading from the periphery of said ramp.

10. A humidifier comprising:

a reservoir for containing a body of water;

an upright helix, said helix being rotatable about its longitudinal axis;

said helix comprising a body portion approximating the shape of a right circular cylinder, and at least one ramp disposed along a helical path on the exterior of said cylindrical body portion and extending generally orthogonally thereto;

a toroidal-shaped float disposed at the bottom of said helix and surrounding said cylindrical bottom portion, said toroidal-shaped float supporting said helix on the surface of said body of water;

an upright columnar structure defining the longitudinal axis of said helix, said helix being journaled thereon; and means for pumping water to the top of said helix whereupon water flows down said helix under the influence of gravity adding humidity to the surrounding atmosphere and rotatably driving said helix due to change of momentum of water flowing down said helix.

* * * * *